United States Patent [19]

Liff

[11] Patent Number: 5,066,157

[45] Date of Patent: Nov. 19, 1991

[54] BRUSH APPLICATOR

[76] Inventor: Lawrence J. Liff, 6025 W. Monroe, Phoenix, Ariz. 85043

[21] Appl. No.: 418,573

[22] Filed: Oct. 10, 1989

[51] Int. Cl.[5] ..... A46B 11/00

[52] U.S. Cl. ..... 401/288; 401/270; 401/282; 401/277

[58] Field of Search ..... 401/288, 270, 282, 277, 401/286, 271, 186

[56] References Cited

U.S. PATENT DOCUMENTS

| | | | |
|---|---|---|---|
| 4,279,527 | 7/1981 | Moe et al. | 401/277 |
| 4,348,126 | 9/1982 | Nigro | 401/288 X |
| 4,786,199 | 11/1988 | Chen | 401/288 |
| 4,789,261 | 12/1988 | Iwase et al. | 401/288 X |
| 4,840,510 | 6/1989 | Yaitz | 401/288 |
| 4,902,152 | 2/1990 | Seidler | 401/288 X |
| 4,908,902 | 3/1990 | McNab et al. | 401/288 X |

FOREIGN PATENT DOCUMENTS

| | | | |
|---|---|---|---|
| 2588460 | 4/1977 | France | 401/288 |

*Primary Examiner*—Robert A. Hafer

*Assistant Examiner*—Kerry Owens

*Attorney, Agent, or Firm*—Woodling, Krost and Rust

[57] ABSTRACT

A brush applicator device is disclosed herein which is adapted for use with a squeeze tube. The applicator device includes an annular mounting member which has an opening extending completely therethrough. The applicator device is adapted to be threadably connected to the squeeze tube and includes a plurality of bristles connected at one end of the mounting member. An extension member extends from one end of the mounting member and terminates in the middle of the bristle members so that material squeezed into the opening from the squeeze tube travels to and is discharged in the middle of the bristle members. A wedge shaped annular sealing member is attached to the mounting member in the area of connection to the end of the squeeze tube and facilitates sealing between the mounting member and the squeeze tube. A bristle area adaptor is also disclosed for use with the brush applicator for the purpose of reducing the area of the bristles when a finer and/or precise area is needed.

5 Claims, 2 Drawing Sheets

BRUSH APPLICATOR

The brush applicator device which is disclosed herein, has as its primary purpose the application of make-up which is contained in a squeeze tube which may be of a plastic material, to which the device attaches, to the human skin without requiring the user to touch the make-up.

The embodiment described herein is an easily attachable and removable applicator which permits the user to apply make-up from a container to either a large area or a small area of the skin as the user's needs may require.

An essential and important component of the basic embodiment herein disclosed, is an annular mounting member. The annular mounting member has a first axial end portion and a second axial end portion. The second axial end portion has an extension member connected to it which extends axially from it. A plurality of bristles are also connected to the second end portion and they surround the extension member and extend generally outward and parallel to and beyond the end of said extension member.

In addition, the annular mounting member has an opening extending through the annular mounting member from the first axial end portion thereof to the end of said extension member. The opening, at the first axial end portion constitutes a means by which the said annular mounting member is attached to the squeeze tube, which means of attachment comprises the opening at the first axial end portion being of complimentary diameter and height and with complimentary threading to accommodate the projection from the squeeze tube to which it attaches.

The opening at the second axial end portion thereof constitutes a direct passageway for the material in the squeeze tube to flow unobstructedly into the midportion of the surrounding bristles.

A more complete understanding of the brush applicator device and it uses may be had be referring to the following description and claims in connection with the accompanying drawings in which:

Figure 1:
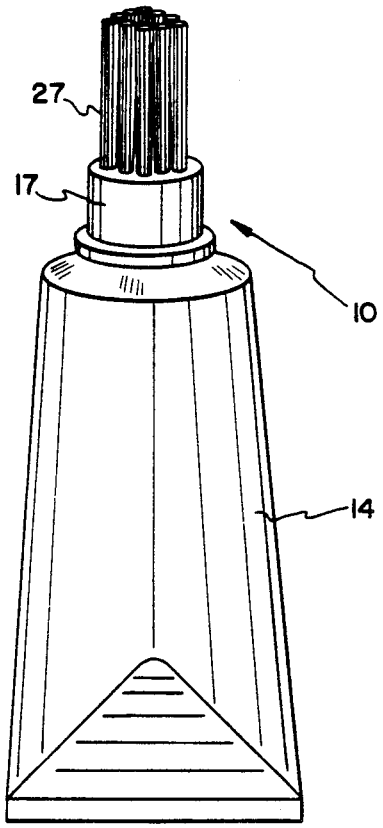
FIG. 1 is a side view of the device which is shown attached to a squeeze tube.
Figure 2:
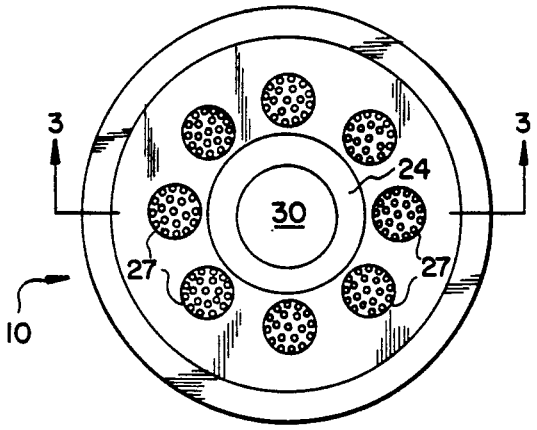
FIG. 2 is an enlarged top view of the device.

The brush applicator device of the present invention has been indicated in the drawings generally by the reference numeral 10 and is shown in its intended environment attached to a squeeze tube 14 which in this configuration is of a plastic composition and which contains a play make-up material for use in dress-up occasions such as Halloween and at other party times. The brush applicator device is attached to the squeeze tube by means of threads 15 which are integrally formed at the top of the squeeze tube in a manner well known to those skilled in the art.

Figure 3:
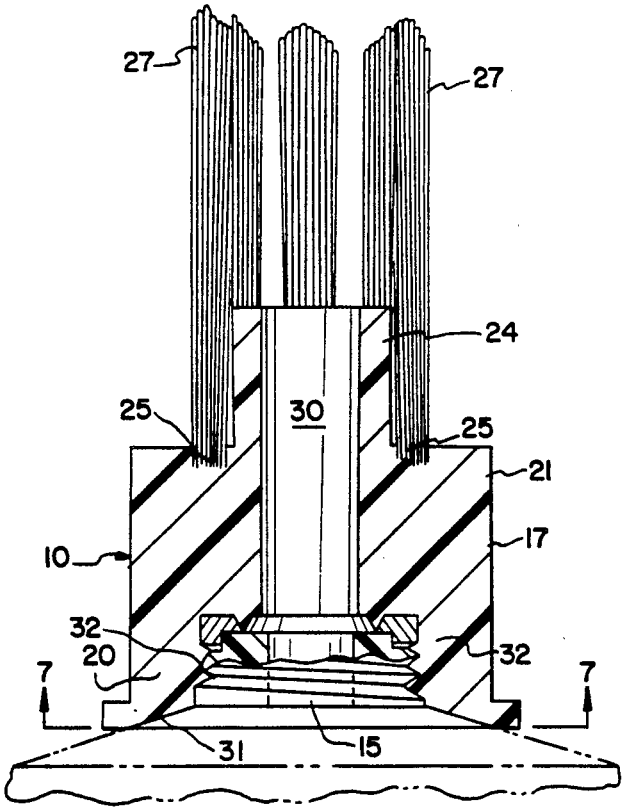
FIG. 3 is a side view of the device in cross-section attached to the squeeze tube and taken generally along the line 3—3 of FIG. 2.
Figure 7:
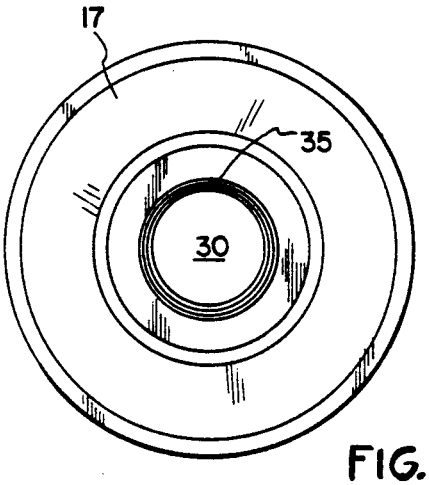
FIG. 7 is a view taken generally along the line 7—7 of FIG. 3 with the squeeze tube removed from the other structure.

The brush applicator device 10 includes in combination an annular mounting member 17 which has first and second end portions 20 and 21 respectively. The preferred material of construction of the member 17 is of an injection molded plastic material as illustrated in the drawings and particularly FIG. 3 thereof. An extension member 24 is formed as a part of the mounting member 17 and is in effect connected to the second axial end portion 21 and extends in an axial direction outwardly therefrom. The parts may be made in one piece or in two pieces which are glued together. A plurality of openings or holes 25 are formed in the second end portion 21 of mounting member 17 and are adapted to receive one end portion of a separate bristle assembly 27. One end of each of the bristle assemblies 27 is shown inserted into and contained in a respective hole 25. The precise method of connection between the ends of the bristles and the holes 25 is not considered a particular part of this invention and the connection might be made by the use of an adhesive or it might be by means of a metal assembly over an end of a given bristle assembly which metal assembly or metal member (not shown) is wedgedly inserted into an opening or hole 25. In any event the bristle assemblies 27 are secured in their respective holes 25 in a manner to maintain them secured therein in a fashion well known to the those skilled in the art.

An opening 30 is formed in the annular mounting member 17 and extends completely through the mounting member from the first axial end portion thereof to the second axial end portion of the extension member 24. Wall means are provided at the opening 30 at the first end portion of the mounting member in the nature of a counterbore which enlarges or opens up the opening 30 at this end portion. Threads 32 are provided on this counterbore or wall means 31 and threads 32 provide a means for threadably securing the brush applicator to the threads 15 on the squeeze tube. A wedge shaped annular sealing member 35 is formed as an integral part of the mounting member 17 at the area of the structure where the opening 30 is widened out or increased in diameter by means of the wall means 31. This wedge shaped sealing member engages the end of the squeeze tube 14 around the opening thereunto to assure the travel of material from the squeeze tube to the bristles 27.

It will be seen that the extreme axial end of the extension member 24 terminates at a position approximately intermediate the ends of the bristle assemblies 27 which enables a user of the device to deliver material from the squeeze tube to the intermediate area of the bristles which facilitates proper positioning of the material in the bristles whereby an operator of the device can apply the fluid medium to the desired areas, i.e. with facial make-up to one's face.

Figure 4:
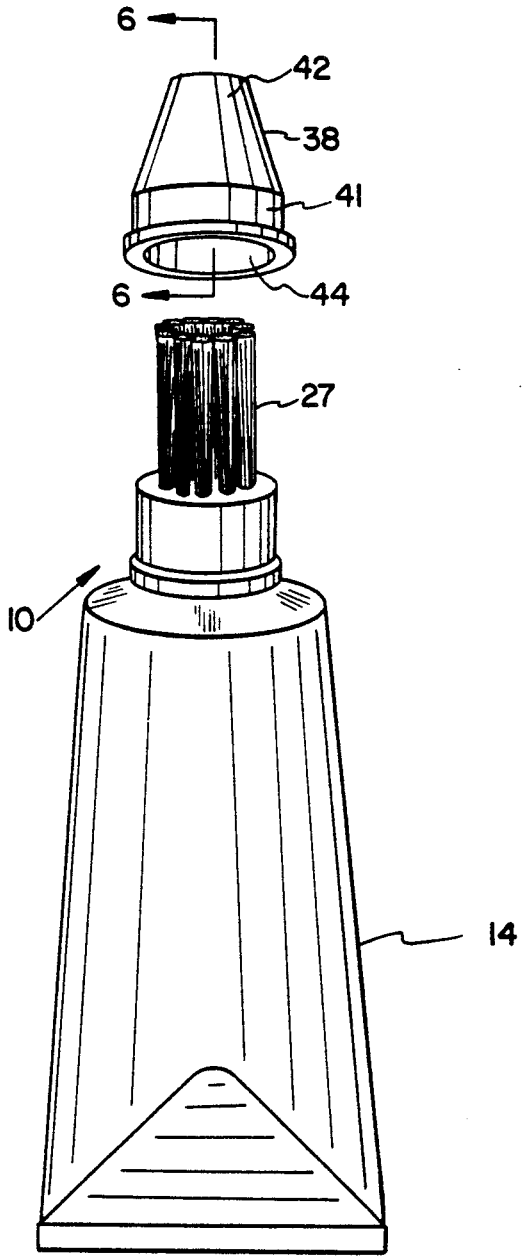
FIG. 4 is a side view of the device which is attached to a squeeze tube and just prior to the attachment of a bristle area adaptor.
Figure 6:
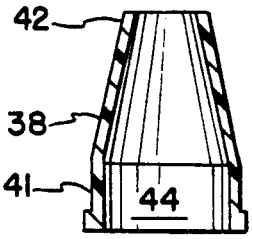
FIG. 6 is a cross-sectional view through a portion of the structure illustrated in FIG. 4.
Figure 5:
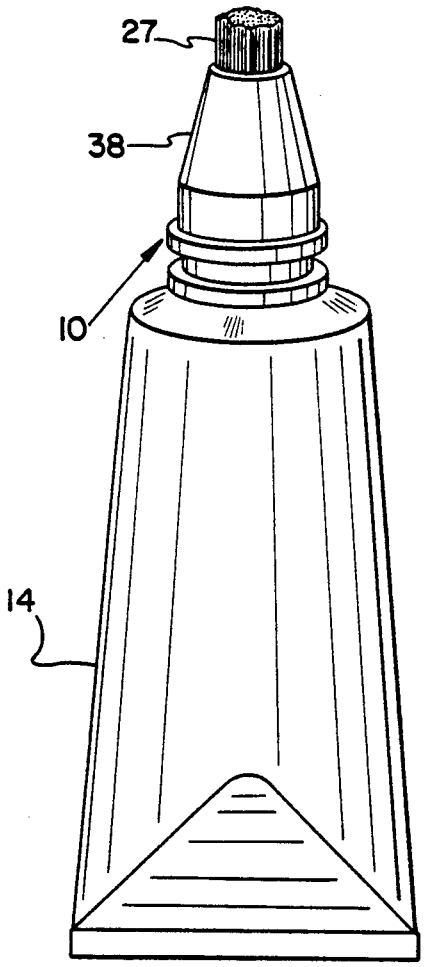
FIG. 5 is a side view of the device attached to a squeeze tube and with the bristle area adaptor in place for use.

The present disclosure and invention also encompasses a structure which is identified as a bristle area adaptor 38 which is illustrated in FIGS. 4 and 5 of the drawings. FIG. 4 illustrates the bristle area adaptor 38 prior to its connection and/or cooperative assembly with the brush applicator 10 and FIG. 5 illustrates the adaptor 38 as positioned upon and in cooperation with the applicator 10. The purpose of the adaptor 38 is to squeeze down or reduce the area of the bristle assemblies 27 when it is desired by a user of the device to apply medium to a smaller or a more precise area. FIG.

4 illustrates the larger bristle area at the extreme ends of the bristles and FIG. 5 illustrates a squeezing down or a constricting of this area of the bristles to enable a user to accomplish a finer application of the desired medium.

The adaptor 40 is generally comprised of an annular member which has first and second end portions 41 and 42 respectively with an opening 44 which extends completely through the device from the first axial end portion thereof to the second axial end portion. Means are provided at the first axial end portion of the opening for attaching the annular member to the brush applicator device 10. In this particular embodiment the means which is provided is simply a very low tolerance fit between the inner diameter of the first end portion 41 and the exterior diameter of the mounting member 17 illustrated in FIGS. 3 through 5. It is possible to provide other means of attachment however this wedging fit has been satisfactory for the intended purposes. The second axial end portion 42 of adaptor 38 comprises the means for compressing the bristles into a smaller area than the bristles occupy in their normal unrestrained condition. This means comprises the gradual reduction of the diameter of the opening 44 as one approaches the second axial end portion from the first axial end portion. The material of construction of the adaptor 38 is preferably a plastic material which is capable of being injection molded in conventional injection molding machines which are used normally for this purpose.

In conclusion the device of the present invention accomplishes the function of enabling medium from a conventional squeeze tube to be applied to and used by a user of a squeeze tube in a much more convenient, economical and facile manner than with prior constructions. The location of the extension member 24 at its extreme end in the intermediate portion of the bristle assemblies facilitates application of the medium to the bristles and obviously adaptor member of FIGS. 4 and 5 enables a variation to be easily accomplished to cover smaller and more precise areas with the applicator device.

The invention has been described in detail with particular emphasis on the preferred embodiments thereof, but it should be understood that variations and modifications within the spirit and scope of the invention may occur to those skilled in the art to which the invention pertains.

What is claimed is:

1. A brush applicator device, for use with a squeeze tube, comprising an annular mounting member, said mounting member having first and second axial end portions, a rigid extension member integrally connected to said second axial end portion and extending axially therefrom, a plurality of bristles permanently connected at one end portion to said second axial end portion and extending outwardly generally parallel to and around and axially beyond an end of said extension member, said extension member having an axial extent of less than one-half the axial extent of such bristles, a generally unobstructed opening extending axially through said annular mounting member from said first axial end portion thereof to said end of said extension member, means at said first axial end portion of said opening for attaching said annular mounting member to the squeeze tube, said end of said extension member being located within said surrounding bristles and intermediate their end portions whereby material from the squeeze tube will be delivered to the middle area of said bristles when pressure is applied to said tube.

2. A device as claimed in claim 1 having in said opening at said first axial end portion, male threads which engage threads on the squeeze tube.

3. A device as claimed in claim 2 having synthetic bristles.

4. A device as claimed in claim 1 having within said opening at said first axial end portion an annularly extending wedge shaped sealing member to engage the end of a squeeze tube for sealing said opening in said annular mounting member from leakage at said annular mounting member's area of attachment to the squeeze tube.

5. A device as claimed in claim 1, having in combination a bristle area adaptor, comprising an annular member, said annular member having first and second axial end portions, an opening extending axially through said annular member, from said first axial end portion thereof to said second axial end portion thereof, means at said first axial end portion of said opening for attaching said annular member to said brush applicator device, means at said second axial end portion of said opening for compressing the said bristles into a smaller area than the said bristles would occupy normally, said bristle area adaptor being readily accessible to a user of the device for ease of connection and disconnection.

* * * * *